US011028728B2

(12) United States Patent
McGuire et al.

(10) Patent No.: US 11,028,728 B2
(45) Date of Patent: Jun. 8, 2021

(54) STRUT DAMPENING ASSEMBLY AND METHOD OF MAKING SAME

(71) Applicant: United Technologies Corporation, Farmington, CT (US)

(72) Inventors: Connor J. McGuire, Hartford, CT (US); Gregory Harrell, Tolland, CT (US); Colby S. Dunn, East Hartford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 35 days.

(21) Appl. No.: 16/361,282

(22) Filed: Mar. 22, 2019

(65) Prior Publication Data

US 2020/0300121 A1 Sep. 24, 2020

(51) Int. Cl.

| | |
|---|---|
| ***F01D 25/16*** | (2006.01) |
| ***F01D 25/24*** | (2006.01) |
| ***F01D 25/04*** | (2006.01) |
| ***F01D 9/06*** | (2006.01) |

(52) U.S. Cl.

CPC ..... *F01D 25/164* (2013.01); *F01D 25/04* (2013.01); *F01D 25/24* (2013.01); *F01D 9/065* (2013.01); *F05D 2230/60* (2013.01); *F05D 2240/14* (2013.01); *F05D 2240/54* (2013.01); *F05D 2260/96* (2013.01)

(58) Field of Classification Search

CPC ..... F01D 25/164; F01D 25/04; F01D 25/24; F01D 9/065; F16F 7/00

See application file for complete search history.

(56) References Cited

U.S. PATENT DOCUMENTS

| | | | | |
|---|---|---|---|---|
| 4,972,671 | A * | 11/1990 | Asselin | F01D 9/065 184/6.11 |
| 5,013,002 | A | 5/1991 | Lefferts et al. | |
| 5,284,011 | A | 2/1994 | Von Benken | |
| 8,209,834 | B2 | 7/2012 | Mons et al. | |
| 9,863,278 | B2 | 1/2018 | Sultana et al. | |
| 10,167,739 | B2 | 1/2019 | Benz et al. | |
| 2009/0272576 | A1 | 11/2009 | Medina | |
| 2015/0204474 | A1 | 7/2015 | Guido et al. | |
| 2017/0254540 | A1 | 9/2017 | DiCintio et al. | |
| 2017/0292449 | A1* | 10/2017 | Agara | F01D 25/18 |
| 2018/0058404 | A1 | 3/2018 | Tibbs | |

(Continued)

FOREIGN PATENT DOCUMENTS

| | | |
|---|---|---|
| FR | 3050229 B1 | 4/2018 |
| WO | 2018172715 A1 | 9/2018 |

OTHER PUBLICATIONS

EP search report for EP20165023.1 dated Jun. 30, 2020.

*Primary Examiner* — Eldon T Brockman
*Assistant Examiner* — Michael K. Reitz
(74) *Attorney, Agent, or Firm* — Getz Balich LLC

(57) ABSTRACT

A strut includes a strut passage extending through the strut along a radial length of the strut. A tube is disposed within the strut passage and is spaced from an interior surface of the strut passage. A grommet is disposed about the tube and is in communication with the interior surface of the strut passage. The grommet defines a compressible zone including a hollow space extending radially through the grommet. The compressible zone is disposed between the tube and the interior surface of the strut passage.

20 Claims, 8 Drawing Sheets

(56) References Cited

U.S. PATENT DOCUMENTS

| | | | | |
|---|---|---|---|---|
| 2018/0058771 | A1* | 3/2018 | Butcher | F16L 9/19 |
| 2018/0202302 | A1 | 7/2018 | Quennehen | |
| 2018/0274389 | A1 | 9/2018 | Miller | |

* cited by examiner

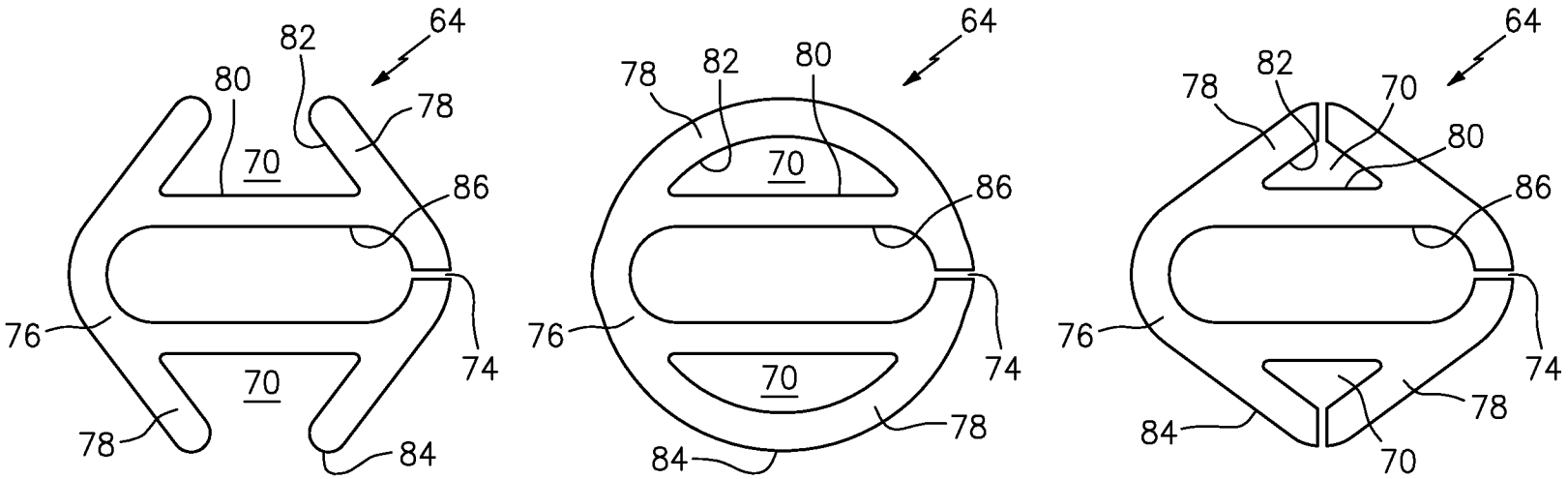
FIG. 6A
FIG. 6B
FIG. 6C
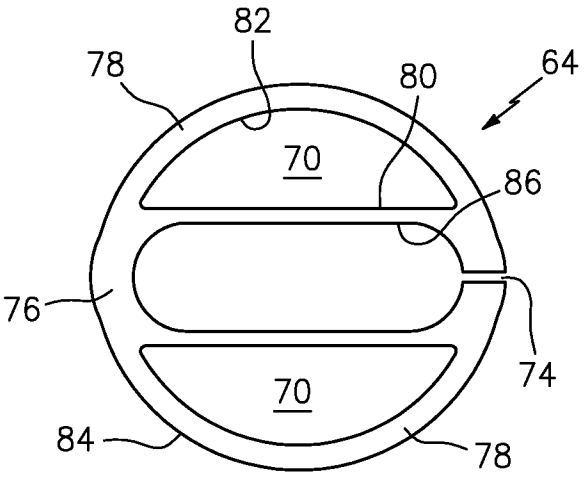
FIG. 6D
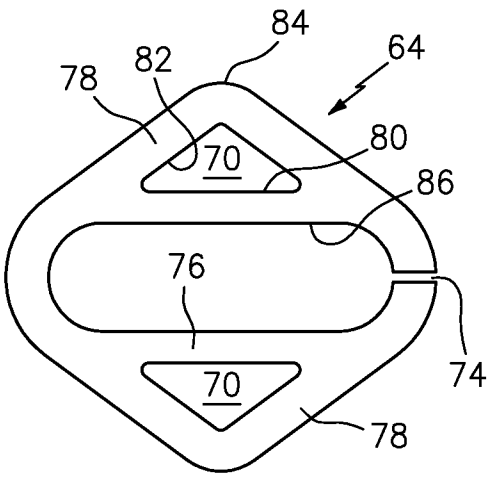
FIG. 6E

STRUT DAMPENING ASSEMBLY AND METHOD OF MAKING SAME

BACKGROUND

1. Technical Field

This disclosure relates generally to gas turbine engines, and more particularly to dampers for supporting tubes therein.

2. Background Information

A gas turbine engine may include one or more frames including an inner hub, an outer casing, and a plurality of spaced-apart struts connecting the hub and casing. One or more of the struts may contain an internal tube configured to convey a fluid. For example, the tube may convey oil to a bearing supported by the hub.

Due to the length and thickness of internal tubes such as those described above, the tubes may have a resonance frequency corresponding to one of the gas turbine engine operating modes. Accordingly, the internal tubes may be susceptible to vibratory fatigue, as a result of normal engine operation, which can degrade the structural integrity of the internal tubes potentially leading to tube fracture. Further, the hollow passage within the strut may have a very small cross-sectional area into which the internal tube must fit.

SUMMARY

According to an embodiment of the present disclosure, a strut includes a strut passage extending through the strut along a radial length of the strut. A tube is disposed within the strut passage and is spaced from an interior surface of the strut passage. A grommet is disposed about the tube and is in communication with the interior surface of the strut passage. The grommet defines a compressible zone including a hollow space extending radially through the grommet. The compressible zone is disposed between the tube and the interior surface of the strut passage.

In the alternative or additionally thereto, in the foregoing embodiment, the grommet includes a first portion disposed about a perimeter of the tube and at least one second portion extending from the first portion away from the tube. An exterior surface of the first portion and an interior surface of the second portion define the compressible zone therebetween. An exterior surface of the second portion forms an interface with the interior surface of the strut passage.

In the alternative or additionally thereto, in the foregoing embodiment, the second portion is in communication with the interior surface of the strut passage and the first portion is spaced from the interior surface of the strut passage.

In the alternative or additionally thereto, in the foregoing embodiment, the strut further includes at least one retention plate projecting outward from the tube proximate a radial end of the grommet. The at least one retention plate is configured to limit radial motion of the grommet along the tube.

In the alternative or additionally thereto, in the foregoing embodiment, the grommet is bonded to the tube.

In the alternative or additionally thereto, in the foregoing embodiment, the strut passage includes an opening to the strut passage through an outer radial end of the strut.

In the alternative or additionally thereto, in the foregoing embodiment, the opening has a first width and the strut passage has a second width greater than the first width.

In the alternative or additionally thereto, in the foregoing embodiment, the grommet is configured to be compressed such that a width of the grommet is less than the first width when the grommet is in a compressed state and greater than the first width when the grommet is in an uncompressed state.

According to another embodiment of the present disclosure, a gas turbine engine includes an inner hub, an outer casing, and a plurality of struts extending radially between and connecting the inner hub to the outer casing. At least one strut of the plurality of struts includes a strut passage extending through the strut along a radial length of the strut. A tube is disposed within the strut passage and is spaced from an interior surface of the strut passage. A grommet is disposed within the strut passage and is spaced from an interior surface of the strut passage. The grommet defines a compressible zone including a hollow space extending radially through the grommet. The compressible zone is disposed between the tube and the interior surface of the strut passage.

In the alternative or additionally thereto, in the foregoing embodiment, the grommet includes a first portion disposed about a perimeter of the tube and at least one second portion extending from the first portion away from the tube. An exterior surface of the first portion and an interior surface of the second portion define the compressible zone therebetween. An exterior surface of the second portion forms an interface with the interior surface of the strut passage.

In the alternative or additionally thereto, in the foregoing embodiment, the gas turbine engine further includes at least one retention plate projecting outward from the tube proximate a radial end of the grommet. The at least one retention plate is configured to limit radial motion of the grommet along the tube.

In the alternative or additionally thereto, in the foregoing embodiment, the strut passage includes an opening to the strut passage through the outer casing and an outer radial end of the strut.

In the alternative or additionally thereto, in the foregoing embodiment, the opening has a first width and the strut passage has a corresponding second width greater than the first width.

In the alternative or additionally thereto, in the foregoing embodiment, the grommet is configured to be compressed such that a width of the grommet is less than the first width when the grommet is in a compressed state and greater than the first width when the grommet is in an uncompressed state.

According to another embodiment of the present disclosure, a method for assembly of a strut for a gas turbine engine is disclosed. A strut including a strut passage extending through the strut along a radial length of the strut and an opening to the strut passage through an outer radial end of the strut is provided. The opening has a first width. At least one grommet is attached to a tube. The at least one grommet defines a compressible zone including a hollow space extending radially through the at least one grommet. The at least one grommet is compressed such that the at least one grommet has a width less than the first width. The tube is inserted into the strut passage via the opening such that the compressible zone is disposed between the tube and an interior surface of the strut passage and the tube is spaced from the interior surface of the strut passage.

In the alternative or additionally thereto, in the foregoing embodiment, the at least one grommet, in an uncompressed state, is in communication with the interior surface of the strut passage when the tube has been inserted into the strut passage.

In the alternative or additionally thereto, in the foregoing embodiment, the grommet includes a first portion disposed about a perimeter of the tube and at least one second portion extending from the first portion away from the tube. An exterior surface of the first portion and an interior surface of the second portion define the compressible zone therebetween. An exterior surface of the second portion forms an interface with the interior surface of the strut passage.

In the alternative or additionally thereto, in the foregoing embodiment, the second portion is in communication with the interior surface of the strut passage and the first portion is spaced from the interior surface of the strut passage.

In the alternative or additionally thereto, in the foregoing embodiment, the strut passage has a second width greater than the first width.

In the alternative or additionally thereto, in the foregoing embodiment, the step of attaching the at least one grommet to the tube includes bonding the at least one grommet to the tube with an adhesive.

The present disclosure, and all its aspects, embodiments and advantages associated therewith will become more readily apparent in view of the detailed description provided below, including the accompanying drawings.

BRIEF DESCRIPTION OF THE DRAWINGS

FIGS. 6A-E illustrate exemplary grommets.

DETAILED DESCRIPTION

Figure 1:
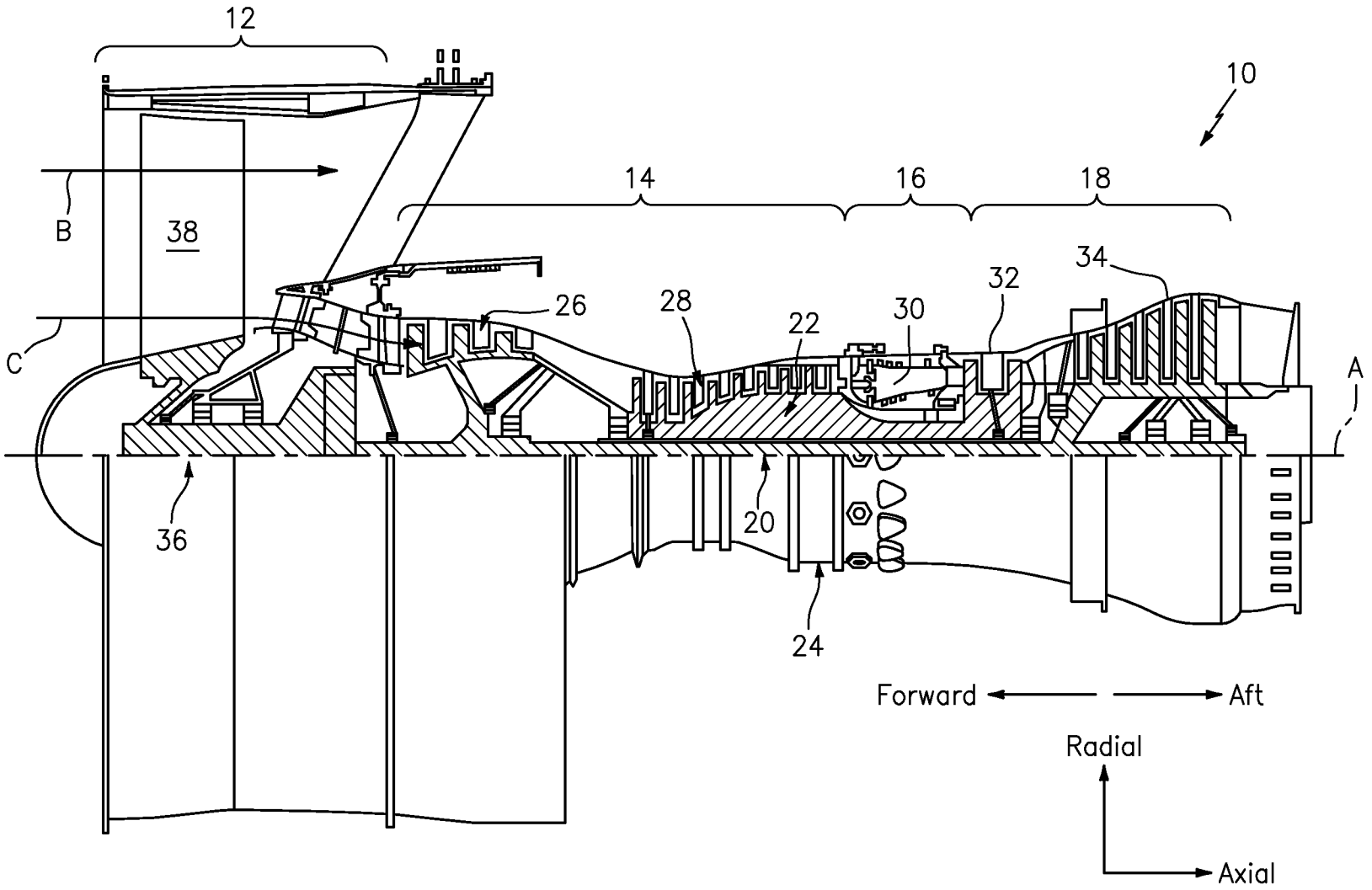
FIG. 1 illustrates a side cross-sectional view of a portion of a gas turbine engine.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

Referring to FIG. 1, a gas turbine engine 10 having a two-spool turbofan configuration is shown. This exemplary embodiment of a gas turbine engine includes a fan section 12, a compressor section 14, a combustor section 16, and a turbine section 18. The fan section 12 drives air along a bypass flow path B in a bypass duct, while the compressor section 14 drives air along a core flow path C for compression and communication into the combustor section 16 then expansion through the turbine section 18.

The exemplary gas turbine engine 10 includes a low-speed spool 20 and a high-speed spool 22 mounted for rotation about an engine central longitudinal axis A relative to an engine static structure 24. Core airflow is compressed by the low-pressure compressor 26 then the high-pressure compressor 28, mixed and burned with fuel in the combustor 30, then expanded over the high-pressure turbine 32 and low-pressure turbine 34. The turbines 32, 34 rotationally drive the respective low-speed spool 20 and high-speed spool 22 in response to the expansion. The low-low-speed spool 20 generally includes a fan shaft 36 from which extends a fan 38. The fan shaft 36 drives the fan 38 directly or indirectly (e.g., through a geared architecture to drive the fan 38 at a lower speed than the low-speed spool 20).

Figure 2:
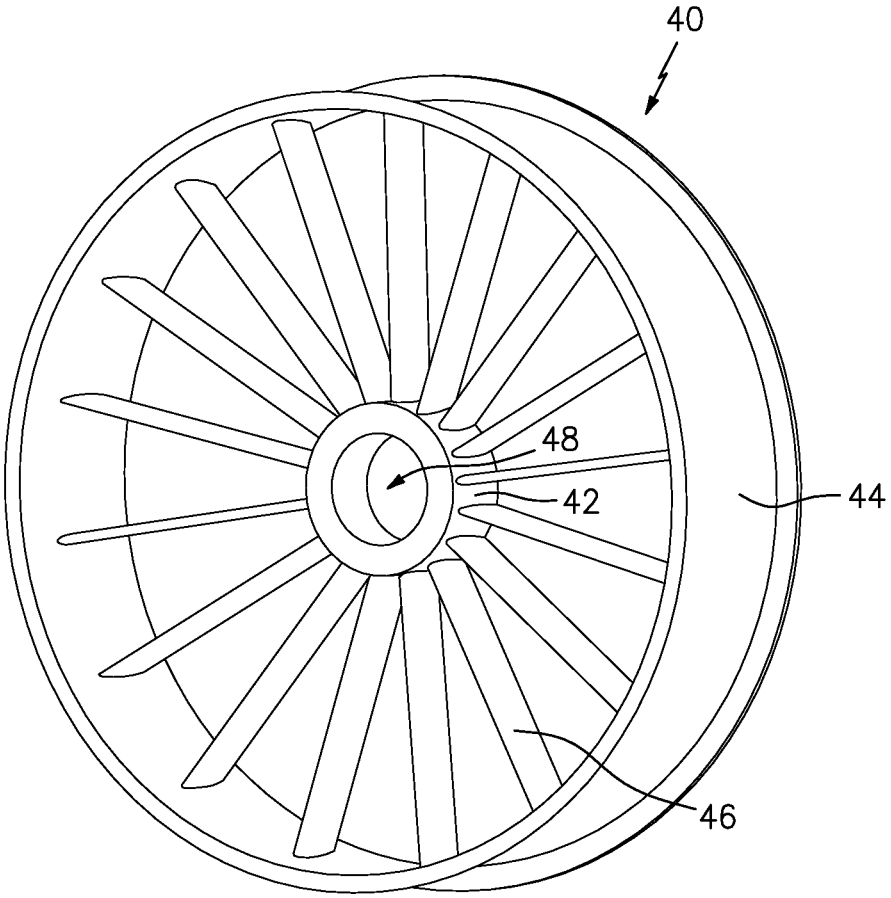
FIG. 2 illustrates a fan frame for a gas turbine engine.

Referring to FIG. 2, the forward end of the fan shaft 36 (see FIG. 1) may be supported by bearings which may in turn be supported by one or more parts of the engine static structure 24, such as fan frame 40. The fan frame 40 includes a radially inner hub 42 and a radially outer casing 44 disposed about the longitudinal axis A. A plurality of circumferentially spaced-apart struts 46 extend radially between and connect the inner hub 42 and the outer casing 44. The inner hub 42 supports a bearing 48 for the rotating fan shaft 36, with the loads therefrom being channeled through the inner hub 42 and the struts 46 to the outer casing 44. While aspects of the present disclosure will be discussed with respect to gas turbine engines 10, and more specifically to fan frames 40, it should be understood that the present disclosure is also applicable to other types of rotational machinery. For example, aspects of the present disclosure could be applicable to a frame of a rotational equipment assembly such as an industrial gas turbine engine, wind turbine, etc.

Referring to FIGS. 3A, 3B, 4, and 5, one or more of the struts 46 may be hollow to provide a reduction in the weight of the gas turbine engine 10 or to permit the passage of air, oil, or other fluids through the struts 46. Struts 46 having a hollow configuration may include a strut passage 50 extending through the strut 46 along a radial length of the strut 46. The strut passage 50 may extend radially between the inner hub 42 and the outer casing 44 for the full radial length of the struts 46. The strut passage 50 may include one or both of an outer strut opening 52 and an inner strut opening 54 extending through a respective first radial end 46E1 and second radial end 46E2 of the struts 46. One or both of the outer strut opening 52 and the inner strut opening 54 may correspond to and be aligned with an opening in the outer casing 44 and the inner hub 42, respectively.

Figure 3A:
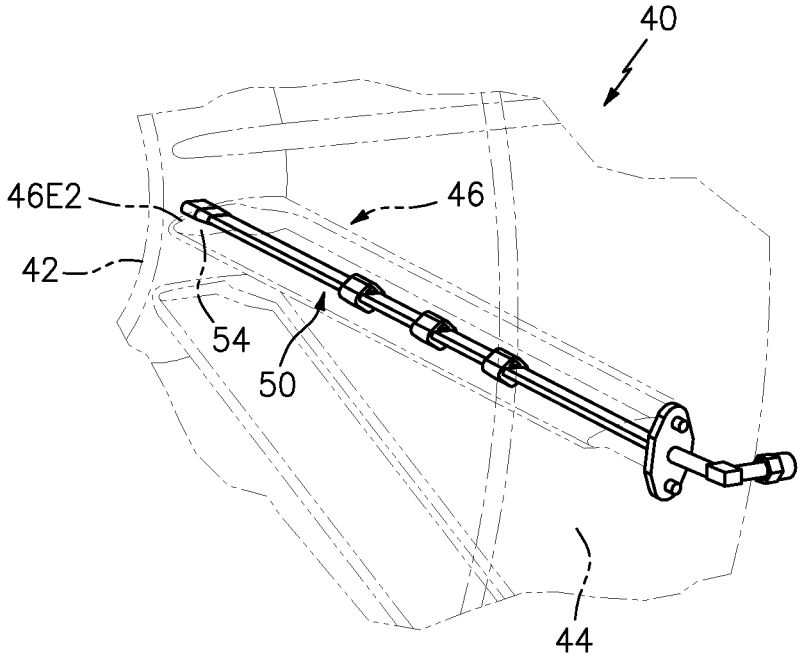
FIG. 3A illustrates a portion of the fan frame of FIG. 2.
Figure 3B:
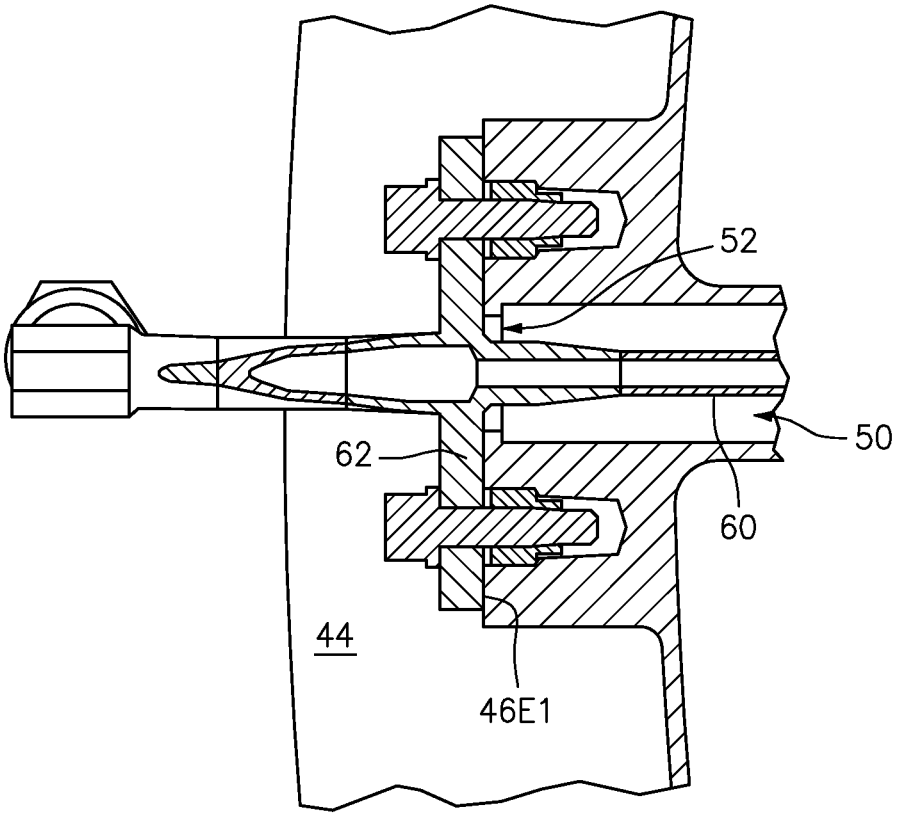
FIG. 3B illustrates a portion of the fan frame of FIG. 2

In some embodiments, inlet air to the gas turbine engine 10 may first pass through the fan frame 40 prior to reaching the fan 38. Accordingly, the struts 46 may have an airfoil shape. As shown in FIG. 3A, the strut passage 50 may have a substantially elliptical cross-sectional shape corresponding to the airfoil shape of the struts 46. With reference to the x-y-z axes illustrated in FIG. 5, the strut passage 50 may have a z-width (i.e., a width extending substantially along the z-axis) having a greater magnitude than an x-width (i.e., a width extending substantially along the x-axis) of the strut passage 50. One or both of the z-width and the x-width of the strut passage 50 may vary along the radial length of the strut passage 50. For example, the z-width of the strut passage 50 may be greater proximate the inner hub 42 than the z-width of the strut passage 50 proximate the outer casing 44. As used herein, the term "substantially" with regard to an angular relationship refers to the noted angular relationship +/−10 degrees.

In some embodiments, one or both of the openings 52, 54 may have a size and/or shape which is different than the size and/or shape of the respective strut passage 50. For example, the outer strut opening 52 may have a z- and/or x-width that is less than the z- and/or x-width of the corresponding strut passage 50. Additionally, in some embodiments, one or both of the openings 52, 54 may have a different shape than the strut passage 50. For example, the strut passage 50 may have a substantially elliptical shape while the outer strut opening 52 may have a substantially circular shape.

One or more of the struts 46 includes a tube 60 disposed within the strut passage 50 and spaced from an interior surface 66 of the strut passage 50. The tube 60 may be configured, to convey oil or other fluids (e.g., cooling air), for example, to the bearing 48 in communication with the fan shaft 36. As shown in FIG. 3A, the tube 60 may extend from a position radially outside of the outer casing 44 to a position radially inside of the inner hub 42. The tube may include a mounting fixture 62 configured to mount the tube to the outer casing 44 or the inner hub 42. The mounting fixture 62 may be mounted to the outer casing 44, for example, by one or more fasteners.

In some embodiments, the tube 60 may have, for example, an elliptical or obround cross-sectional shape corresponding to the shape of the respective strut passage 50 (i.e., the tube 50 may have a greater z-width than x-width). In other embodiments, the tube 60 may have a round cross-sectional shape or any other suitable shape for disposition within the strut passage 50 while being spaced from the interior surface 66 of the strut passage.

The tube 60 may include one or more grommets 64 configured to dampen vibrational forces between the tube 60 and the respective strut 46. The grommet 64 may be disposed about the tube 60 (e.g., a perimeter of the tube 60) and in communication with the interior surface 66 of the strut passage 50. The grommet 64 may further maintain an interface 68 between the grommet 64 and the interior surface 66 throughout a range of gas turbine engine operating modes so as to prevent contact between the tube 60 and the interior surface 66. Accordingly, the grommet 64 may prevent rubbing between the tube 60 and the interior surface 66 thereby preventing the formation of wear particles within the strut passage 50. In some embodiments, the grommet 64 may be bonded to the tube 60 with a suitable adhesive.

Figure 4:
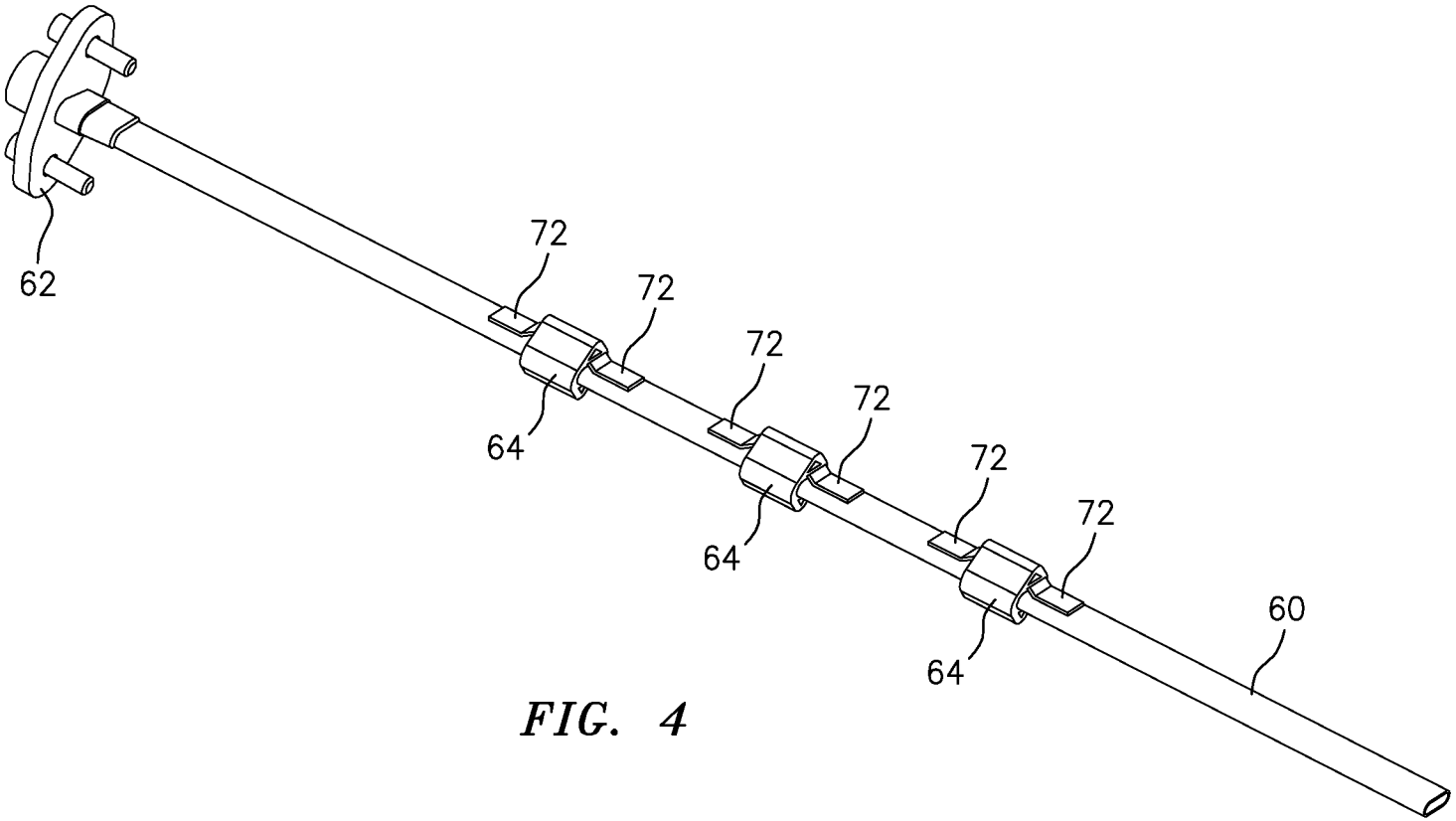
FIG. 4 illustrates a tube of the fan frame of FIG. 2.
Figure 5:
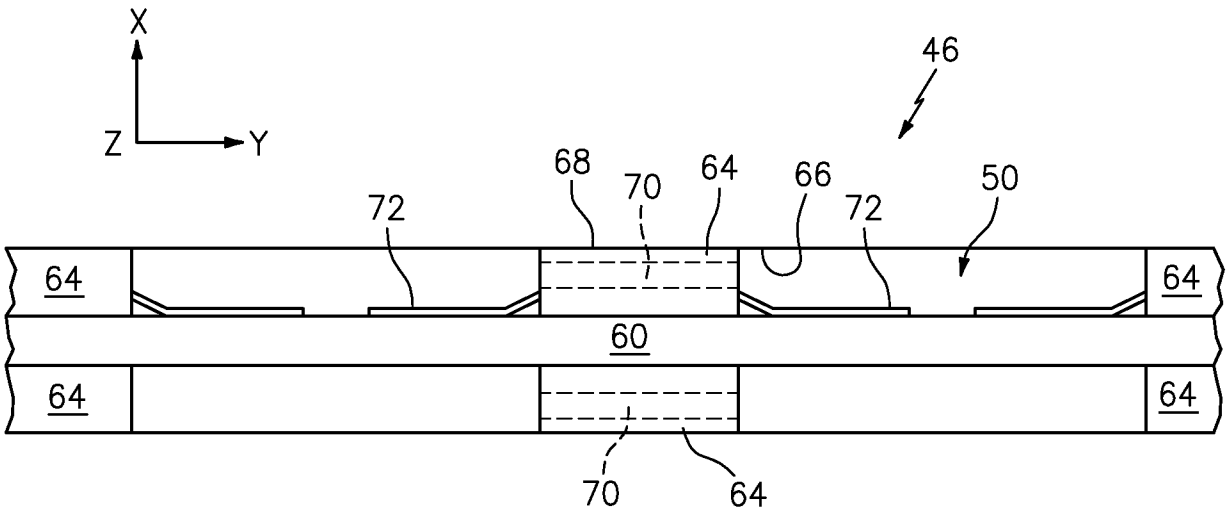
FIG. 5 illustrates a side cross-sectional view of a strut of the fan frame of FIG. 2.

In some embodiments, the tube 60 may include one or more retention plates 72 disposed along the tube 60 and projecting outward from the tube 60 proximate a radial end of the grommet 64. The retention plate 72 may be configured to limit radial motion of the grommet 64 along the tube 60. For example, as shown in FIGS. 4 and 5, one or more retention plates 72 may be disposed on the tube 60 radially above and/or below the grommet 64 in order to limit radial movement of the grommet 64. In some embodiments, the retention plate 72 may be bonded or braised to the exterior surface of the tube 60.

Referring to FIGS. 6A-6E, several non-limiting exemplary embodiments of the grommet 64 are illustrated. The grommet 64 includes a first portion 76 having an interior surface 86 configured for disposition about the perimeter of the tube 60. The first portion 76 may include a grommet opening 74 configured to allow the first portion 76 to be opened and positioned about the tube 60. A second portion 78 of the grommet 64 extends from the first portion 76 in a direction generally away from the tube 60. An exterior surface 80 of the first portion 76 and in interior surface 82 of the second portion 78 define a compressible zone 70 defined by a hollow space extending radially through the grommet 64 and disposed between the tube 60 and the interior surface 66 of the strut passage 50. An exterior surface 84 of the second portion 78 forms the interface 68 between the grommet 64 and the interior surface 66 of the strut passage 50 (see FIG. 5).

FIGS. 6A-6E illustrate several non-limiting exemplary embodiments of the grommet 64. The grommet 64 may include two second portions 78 extending from the first portion 76 opposite one another with respect to the tube 60. In some embodiments, the second portion 78 may include two or more independent portions extending from the first portion 76. In operation, the compressible zone 70 may expand or contract (i.e., the volume of the compressible zone 70 may increase or decrease) in response to external forces such as vibratory forces within the struts 46, thereby dampening the vibratory forces applied to the tube 60. As will be discussed, the compressible zone 70 may also expand and contract as a result of forces applied during assembly of the struts 46. The first and second portions 76, 78 may be of any suitable thickness. In some embodiments, the first and second portions 76, 78 may have different thicknesses while in some other embodiments they may have a same thickness.

Referring again to FIGS. 3A and 3B, the outer strut opening 52 may have a width which is smaller than a respective width of the strut passage 50. Accordingly, in order to maintain contact with the interior surface 66 of the strut passage 50 during gas turbine engine 10 operation, the grommet may be compressible such that, during installation, it can pass through the outer strut opening 52 and subsequently expand to form the interface 68 with the interior surface 66.

In some embodiments, the grommet 64 may be made of silicone, rubber, or any other suitable material for constraining vibratory amplitude of the tube 60 while being capable of compression for insertion into the strut passage 50. The dampers 60 may be procured by a number of different methods, for example, additive manufacturing, laser cutting, milling, water jetting, casting, etc. In some embodiments, the interior surface 66 of the strut passage 50 may have a rough surface finish. Accordingly, the material of the grommet 64 may be selected such that the interface between the grommet 64 and the interior surface 66 of the strut passage 50 does not cause the formation of wear particles as a result of relative motion between the grommet 64 and the interior surface 66.

Figure 7:
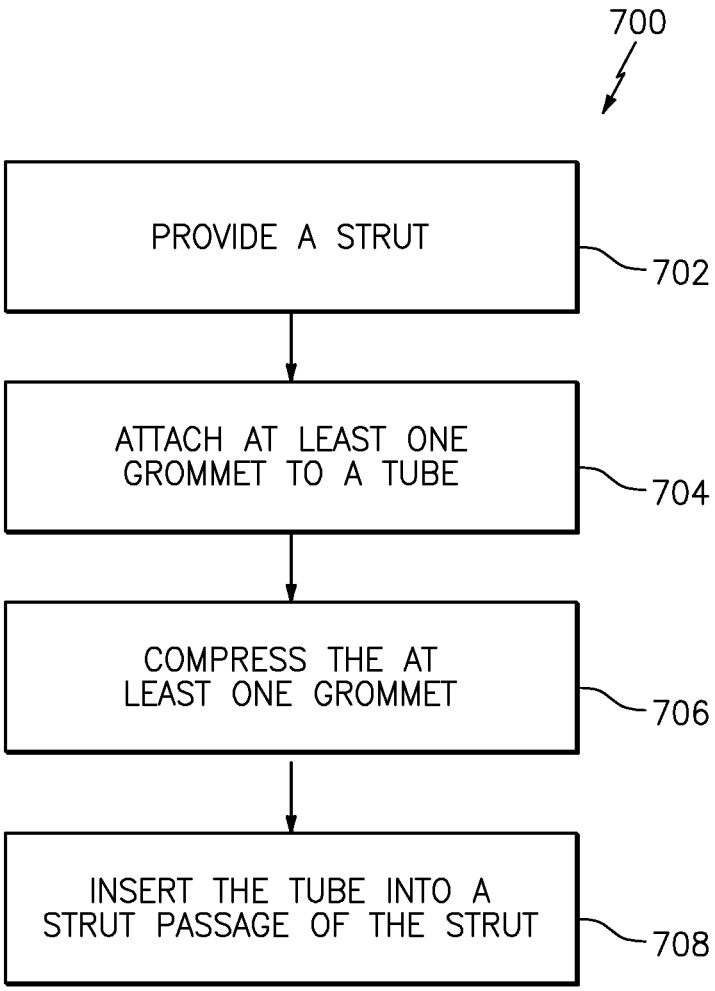
FIG. 7 is a flowchart for a method of assembling a strut for a fan frame.

Referring to FIG. 7, a method 700 for assembling a strut 50 for a gas turbine engine 10 is illustrated. In block 702, the strut 46 having a strut passage 50 is provided. In block 702, at least one grommet 64 is attached to the tube 60 in preparation for insertion of the tube 60 into the strut passage 50. As previously discussed, in some embodiments, the grommet 64 may be bonded to the tube 60. In block 706, the grommet 64 is compressed such that the grommet 64 has a width that is less than a corresponding width of the outer strut opening 52. For example, the compressible zone 70 of the grommet 64 may be compressed such that the width of the grommet 64 between opposing distal surfaces of the second portions 78 of the grommet 64 is less than a corresponding (e.g., tangential) width of the outer strut opening 52. In block 708, the tube 60 is inserted into the strut passage 50 via the outer strut opening 52. Subsequent to insertion into the strut passage 50, the grommet returns to an uncompressed state thereby forming the interface 68 with the interior surface 66 of the strut passage 50. As used herein, the "uncompressed state" refers to the condition of the grommet 64 absent the compressive force applied for inserting the grommet 64 through the outer strut opening 52. As one of ordinary skill in the art will understand, the grommet 64 may still be compressed to some degree within the strut passage 50 by the interior surface 66.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. Accordingly, the present disclosure is not to be restricted except in light of the attached claims and their equivalents.

What is claimed is:

1. A strut comprising:

a strut passage extending through the strut along an axial length of the strut;

a tube disposed within the strut passage and spaced from an interior surface of the strut passage; and a grommet disposed about the tube and in communication with the interior surface of the strut passage, wherein the grommet defines a compressible zone comprising a hollow space extending axially through the grommet and the hollow space is completely surrounded by the grommet along an axial extent of the hollow space; and wherein the grommet comprises a first portion disposed about and contacting a perimeter of the tube and at least one second portion extending from the first portion away from the tube, wherein the compressible zone is defined radially between an outer radial surface of the first grommet portion and an inner radial surface of the second grommet portion.

2. The strut of claim 1, wherein an outer radial surface of the second portion forms an interface with the interior surface of the strut passage.

3. The strut of claim 2, wherein the first portion is spaced from the interior surface of the strut passage.

4. The strut of claim 1, further comprising at least one retention plate projecting radially outward from the tube proximate an axial end of the grommet, the at least one retention plate configured to limit axial motion of the grommet along the tube.

5. The strut of claim 1, wherein the grommet is bonded to the tube.

6. The strut of claim 1, wherein the strut comprises an opening to the strut passage through an outer axial end of the strut.

7. The strut of claim 6, wherein the opening has a first width and the strut passage has a second width greater than the first width.

8. The strut of claim 7, wherein the grommet is configured to be compressed such that a width of the grommet is less than the first width when the grommet is in a compressed state and greater than the first width when the grommet is in an uncompressed state.

9. A gas turbine engine comprising:

an inner hub;

an outer casing; and a plurality of struts extending between and connecting the inner hub to the outer casing, at least one strut of the plurality of struts comprising:

a strut passage extending through the strut along an axial length of the strut;

a tube disposed within the strut passage and spaced from an interior surface of the strut passage; and a grommet disposed about the tube and in communication with the interior surface of the strut passage, wherein the grommet defines a compressible zone comprising a hollow space extending axially through the grommet and the hollow space is completely surrounded by the grommet along an axial extent of the hollow space; and wherein the grommet comprises a first portion disposed about and contacting a perimeter of the tube and at least one second portion extending from the first portion away from the tube, wherein the compressible zone is defined radially between an outer radial surface of the first grommet portion and an inner radial surface of the second grommet portion.

10. The gas turbine engine of claim 9, wherein an outer radial surface of the second portion forms an interface with the interior surface of the strut passage.

11. The gas turbine engine of claim 9, further comprising at least one retention plate projecting radially outward from the tube proximate an axial end of the grommet, the at least one retention plate configured to limit axial motion of the grommet along the tube.

12. The gas turbine engine of claim 9, wherein the strut comprises an opening to the strut passage through the outer casing and an outer axial end of the strut.

13. The gas turbine engine of claim 12, wherein the opening has a first width and the strut passage has a corresponding second width greater than the first width.

14. The gas turbine engine of claim 13, wherein the grommet is configured to be compressed such that a width of the grommet is less than the first width when the grommet is in a compressed state and greater than the first width when the grommet is in an uncompressed state.

15. A method for assembling a strut for a gas turbine engine comprising:

providing a strut comprising a strut passage extending through the strut along an axial length of the strut and an opening to the strut passage through an outer axial end of the strut, the opening having a first width;

attaching at least one grommet to a tube, the at least one grommet defining a compressible zone comprising a hollow space extending axially through the at least one grommet and the hollow space is completely surrounded by the at least one grommet along an axial extent of the hollow space, the grommet comprising a first portion disposed about and contacting a perimeter of the tube and at least one second portion extending from the first portion away from the tube, wherein the compressible zone is defined radially between an outer radial surface of the first grommet portion and an inner radial surface of the second grommet portion;

compressing the at least one grommet such that the at least one grommet has a width less than the first width; and inserting the tube into the strut passage via the opening such that the compressible zone is disposed between the tube and an interior surface of the strut passage and the tube is spaced from the interior surface of the strut passage.

16. The method of claim 15, wherein the at least one grommet, in an uncompressed state, is in communication with the interior surface of the strut passage when the tube has been inserted into the strut passage.

17. The method of claim 15, wherein an outer radial surface of the second portion forms an interface with the interior surface of the strut passage.

18. The method of claim 17, wherein the first portion is spaced from the interior surface of the strut passage.

19. The method of claim 15, wherein the strut passage has a second width greater than the first width.

20. The method of claim 15, wherein the step of attaching the at least one grommet to the tube includes bonding the at least one grommet to the tube with an adhesive.

* * * * *